United States Patent [19]

Ammann

[11] Patent Number: 4,576,120

[45] Date of Patent: Mar. 18, 1986

[54] HEAT EXCHANGER

[75] Inventor: Heinz Ammann, Winterthur, Switzerland

[73] Assignee: Sulzer Brothers Limited, Winterthur, Switzerland

[21] Appl. No.: 645,718

[22] Filed: Aug. 30, 1984

[30] Foreign Application Priority Data

Sep. 8, 1983 [CH] Switzerland ..... 4903/83

[51] Int. Cl.[4] ..... F22B 37/00

[52] U.S. Cl. ..... 122/6 A; 122/510

[58] Field of Search ..... 122/510, 511, 6 A; 52/261

[56] References Cited

U.S. PATENT DOCUMENTS

| | | | |
|---|---|---|---|
| 3,007,455 | 11/1961 | Lieb et al. | 122/6 A |
| 3,277,870 | 10/1966 | Reale | 122/510 X |
| 3,357,408 | 12/1967 | Patterson | 122/510 X |
| 3,760,774 | 9/1973 | Michel | 122/510 |
| 3,814,063 | 6/1974 | Bijmholt | 122/510 X |
| 4,240,234 | 12/1980 | Eisinger et al. | 122/6 A X |

*Primary Examiner*—Edward G. Favors

*Attorney, Agent, or Firm*—Kenyon & Kenyon

[57] ABSTRACT

The support girders of the heat exchanger are connected at the ends to a tension band on an adjacent wall by a connection with transfers stress in a symmetric manner. A connecting element is welded to a tension band in a symmetric manner and carries pivot links which, in turn, are articulated to the end of a girder. Loads from the girder are transferred to the tension band in the central plane of the tension band.

11 Claims, 9 Drawing Figures

HEAT EXCHANGER

This invention relates to a heat exchanger. More particularly, this invention relates to a steam or vapor generator.

Heretofore, heat exchangers which have been constructed for use as steam or vapor generators have frequently been made up of a plurality of walls, each of which includes a plurality of interconnected tubes through which a working medium flows. In such cases, the heat exchangers have been provided with flanged girders which extend across and which are connected to the respective walls of the heat exchanger in order to receive flexural stresses from the walls and to transmit the stresses about the periphery of the heat exchanger.

In one known heat exchanger, a flanged girder has been connected at the ends to an adjacent wall by means of a tension band secured to each respective adjacent wall. In this case, the tension band is rigidly connected to the adjacent wall and is connected to the girder by means of a connecting element and a link. For example, the connecting element has been constructed of parallel sheet metal members having bores arranged seriatim in the longitudinal direction of the steam generator through which link bolts extend substantially parallel to the wall.

In this known construction, in addition to the tensile loading of the tension band, there is a force which is equal to the force transmitted by the link multiplied by the distance between the link axis on the tension band side and the tension band itself. This force tends to lift part of the tension band away from the wall or to cause the wall to bulge outwardly. This additional loading, in the long term, results in fatigue phenomena in the region of the edge between the two adjoining walls.

Reinforcing the wall near the tension band or providing a more favorable configuration of the edge between two adjoining walls results in very expensive solutions to the above problem. Further, these solutions are usually unsatisfactory because of the thermal stresses which arise from the accumulation of material.

Accordingly, it is an object of the invention to avoid a fatigue phenomena in the support structure of a heat exchanger formed of walls of interconnected tubes.

It is another object of the invention to provide a relatively simple and inexpensive heat exchanger wherein the walls of the exchanger can be supported in a manner which does not impose additional thermal stresses.

Briefly, the invention is directed to a heat exchanger which is constructed of a plurality of walls which define a flue and wherein each wall includes a plurality of interconnected tubes. In addition, the heat exchanger has at least one flanged girder extending parallel to one of the walls for receiving flexural stresses from the wall while a tension band is rigidly connected in parallel to a second wall adjacent this wall. In accordance with the invention, at least one connecting element is rigidly connected to the tension band at predetermined fixing points disposed symmetrically of a central plane of the tension band while at least one link is mounted on the connecting element and is pivotally connected to the end of the girder on an axis parallel to the second wall and perpendicular to the girder. This link is further disposed to transfer a flexural stress from the girder to the tension band within the central plane of the tension band.

The construction of the connection between the girder and the tension band is such that the bending moment on the wall to which the tension band is fixed is practically eliminated by the symmetrical arrangement of the fixing points of the connecting element on both sides of the tension band along with the arrangement of the point of action of the force transmitted to the connecting element by the link.

An additional advantage of the connection is that the fixing points between a tension band, the second wall and the connecting element are subjected practically only to shearing stress. This is of advantage both in terms of strength as well as simplification and clarification of the strength of calculations.

Since no additional accumulation of material is required for the connection, no additional thermal stresses are created thereby.

In order to accommodate the connection, the second wall has a portion bent around the connecting element and spaced from the tension band. This relatively small deflection of the wall near the connecting element permits the connection to be generally applicable to all the walls.

In one embodiment, where the second wall includes a plurality of webs interconnecting the tubes, at least some of the webs are connected to the connecting element so that the second wall itself defines at least a part of the tension band. This provides an optimum aspect of the connection which can be applied even to heat exchangers which are welded in seal-tight relationship. This can be accomplished simply by slightly extending the second wall of the heat exchanger beyond the edge of the wall to which the girder is secured. In this case, the central plane of the tension band and the plane of the second wall coincides so that there are no forces acting on the second wall. A separate connection between a tension band and a second wall are also eliminated.

In another embodiment, the connecting element may be made of a sheet metal member. In this construction, the sheet metal member can be readily welded to the webs of a wall of a heat exchanger.

In still another embodiment, the connecting element may be formed of at least one pair of sheet metal members which are disposed seriatim. This permits the angle between the parallel pivot axes of the links and central plane of the tension band to be a free choice.

In still another embodiment, an intermediate member may be connected between a tension band and the link to rotate on an axis in the central plane and perpendicular to the link. An accurate adjustment of the angle between the flanged girder and the second wall thus becomes unnecessary. This obviates any stresses and greatly simplified the assembly of the connection.

Further, the heat exchanger may also have a pair of links pivotally mounted on the connecting element on axes disposed perpendicularly of the connecting element. The provision of more than one link between the end of the girder and the tension band promotes the transmission of larger forces. Further, with an element secured to the girder and pivotally connected to the links on axes parallel to and symmetrical of the links, the tension band and the wall to which the band is secured are free of the additional bending loads which are produced by any girder deformation perpendicular to the wall.

These and other objects and advantages of the invention will become more apparent from the following detailed description taken in conjunction with the accompanying drawings wherein.

Figure 1:
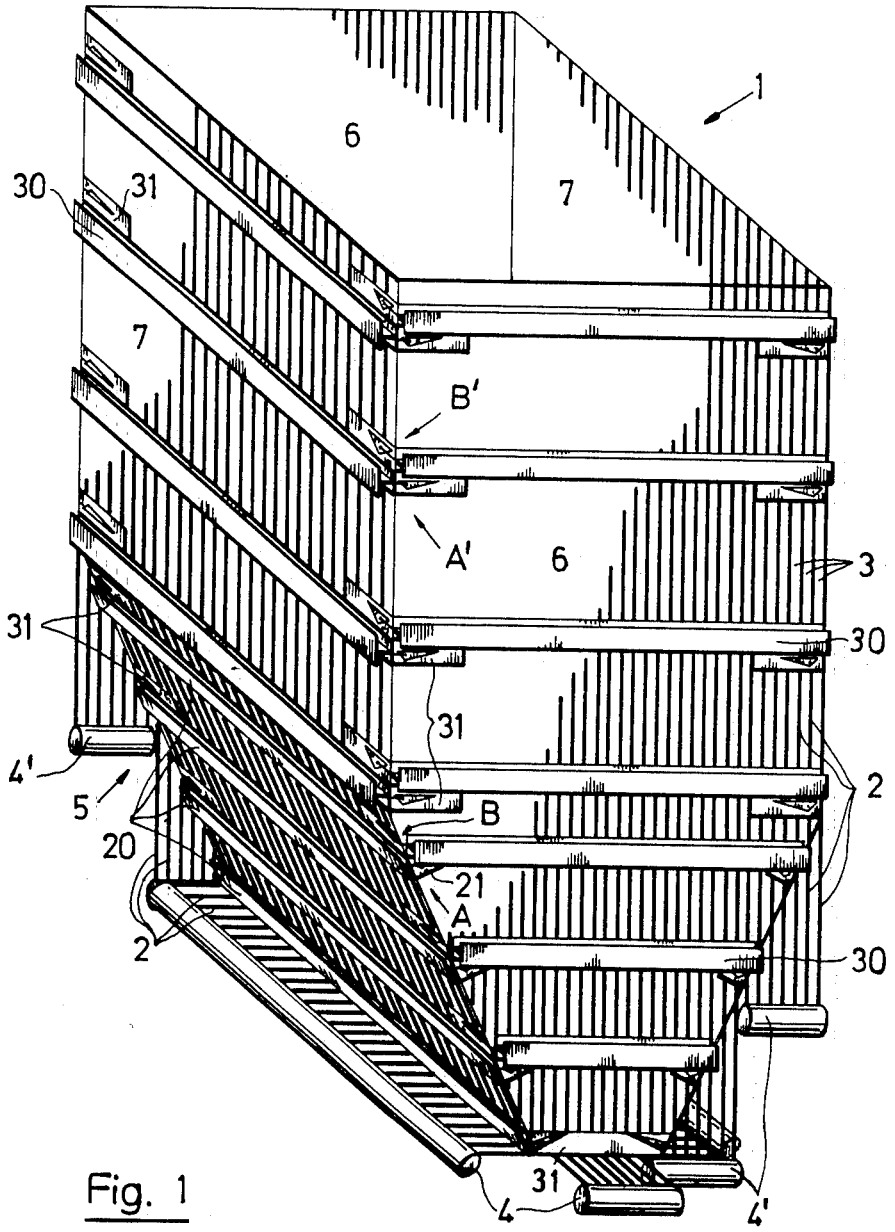
FIG. 1 illustrates a diagramatic perspective of a heat exchanger constructed in accordance with the invention.

Referring to FIG. 1, the heat exchanger is constructed for use as a steam or vapor generator 1. In this regard, the heat exchanger includes a plurality of walls which define a flue; each of which walls includes a plurality of tubes 2 which are interconnected as by welding together by means of web 3 so as to be sealtight. As indicated, the wall tubes 2 are vertically disposed and form four walls, two of which walls 6 extend vertically and two walls 7 of which are bent inwardly at a lower end so as to extend at an angle in the bottom part of the steam generator 1.

The bottom part of the steam generator 1 forms a funnel or hopper 5, the bottom four edges of which define an elongate opening (not shown) around which the wall tubes 2 are bent outwardly so as to extend horizontally. As indicated, the tubes 2 lead into four horizontal headers 4. The webs 3 extend only as far as the opening of the funnel 5 and are not bent over towards the headers 4. As a result of the inclined configuration of the lower part of the walls 7, an edge forms in the area of the funnel 5 which extends at an angle. Along this edge, some of the wall tubes 2 in the vertical walls 6 leave the walls 6 and continue to extend vertically until leading into horizontal headers 4'. In order to avoid excessively long tube parts outside the wall 6, the headers 4' are arranged in stagnate relationship in two layers, each layer accommodating substantially half the wall tubes 2 leaving the wall 6 along the inclined edges.

The steam generator 1 extends upwardly as far as connections (not shown) to a support structure from which the generator is suspended.

A cooling medium flows in the wall tubes 2 from the headers 4, 4' upwardly to other headers (not shown). Hot combustion gases which originate from burners (not shown) at the periphery of the steam generator 1 also flow upwardly and yield heat to the cooling medium flowing in the wall tubes 2. Any solid and/or liquid deposits from the combustion gases, e.g. ash, drop down inside the steam generator 1 and are guided by the funnel 5 towards the elongate opening, through which they leave the interior of the steam generator 1. The walls 6, 7 expand and contract both vertically and horizontally as a result of the heating and cooling during operation.

Flexural stresses on the walls 6 and 7 such as may arise due to explosions and implosions inside the steam generator 1 are taken by horizontal flanged girders 20, 30. The girders 30 are secured along and parallel to the vertical walls or wall parts. The girders 20 are secured to the inclined part of the walls 7, and also extend parallel to these inclined wall parts. Since the walls 6, 7 expand and contract horizontally as well due to heat absorption while the girders 20, 30 are relatively cold and accordingly remain substantially rigid, the connection between the walls 6, 7 and the girders 20, 30 is made to slide horizontally to allow different thermal expansions in that direction. At the end parts, each girder 20, 30 is connected via a connection to the wall adjacent to the wall which is parallel to the girder. Thus, outwardly directed flexural stresses are transmitted to the girder by a wall braced by the same, and are then transmitted by the girder via the end parts to the adjacent walls substantially as a tensile stress. The stress is then taken by the adjacent walls by means of tension bands 21, 31 respectively. As illustrated, the girders on one wall are disposed on levels which are spaced from the levels of the girders on the adjacent walls.

Figure 3:
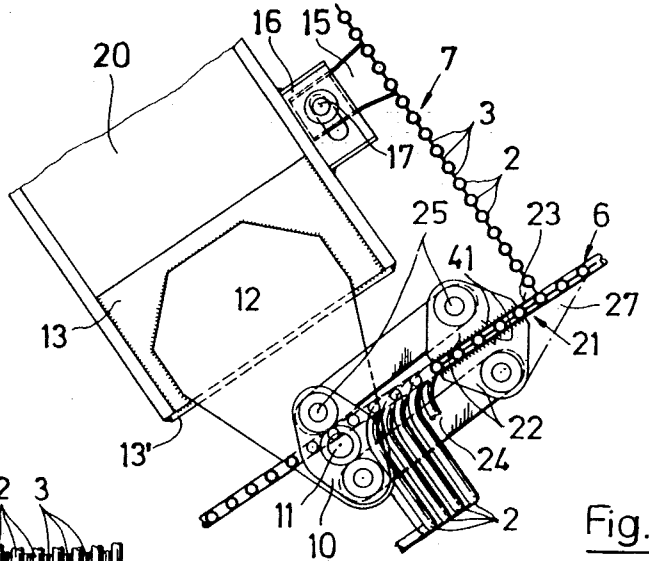
FIG. 3 illustrates a view taken on line III—III of FIG. 2.
Figure 2:
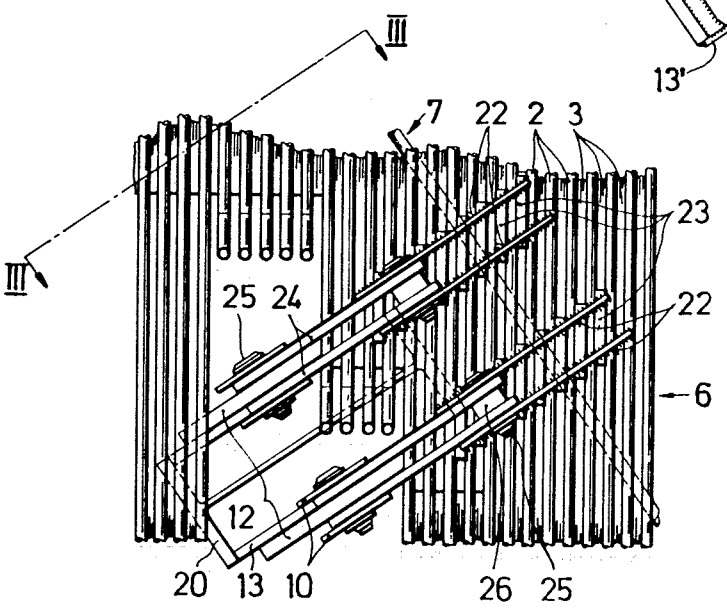
FIG. 2 illustrates an enlarged detail view of one connection constructed in accordance with the invention.

Referring to FIGS. 2 and 3, the connection at point A of FIG. 1 for a flanged girder 20 extending parallel to an inclined part of one of the walls 7 and perpendicularly to the wall tubes 2 forming a wall 7 requires the wall tubes 2 emerging from the vertical wall 6 at the edge between the adjoining walls 6, 7 to form extensions of the vertical wall 6 in the outward direction. In this embodiment, parts of the wall 6 themselves become a tension band 21 as a result of additional reinforcement of these extensions of the wall 6 by means of rectangular reinforcing plates 23.

The connection includes four connecting elements 22, each of which is rigidly connected as by welding to the tension band 21 at predetermined fixing points 41. In this case, each connecting element 22 is formed of a flat piece of sheet metal which is disposed in parallel with the other connecting elements 22. The connecting elements 22 extend perpendicularly both to the vertical wall 6 and to the inclined part of the wall 7 and are arranged in pairs symmetrically to the girder 20 (see FIG. 2).

The connection also has two pairs of links 24 which serve to connect the tension band 21 to a girder 20. Each pair of links 24 is mounted on and between a pair of connecting elements 22 about a link pin 25 mounted in the pair of connecting elements 22. In like manner, the opposite ends of each pair of links 24 are pivotally disposed about link pins 25 which, in turn, are each carried in a pair of parallel spaced apart elements 10 (see FIG. 3). Suitable spacer tubes 26 are disposed concentrically about the respective link pins 25 to maintain the spacing between the links 24.

The girder 20 is of H-section having a web which is perpendicular to the inclined wall 7 (see FIG. 2). In addition, the girder is connected to the wall by way of a horizontal slide connection which includes a support bracket 15 secured to the wall 7, a support bracket 16 which is secured to the girder 20 and a pin 17 which is rigidly connected to the support bracket 15 but which slides in a slot in the support bracket 16. In this way, the girder 20 is longitudinally slidable with respect to the wall 7 to allow differential thermal expansion between the girder 20 and the wall 7.

As shown in FIG. 3 the girder 20 is reinforced at the end by two support plates 13 which extend parallel to the web and an end plate 13' which extends perpendicularly thereto. In addition, the connection between the girder 20 and tension band 21 includes a pair of sheet metal guides 12 which are welded onto the support plates 13 in parallel relation. These guides, in turn, each carry a pivot pin 11 about which the pairs of elements 10 are pivotally mounted.

As indicated in FIGS. 2 and 3, the end of the links 24 which are adjacent the girder 20 extend between the pivotable elements 10 and the guide 12 disposed therebetween so that the pins 25 each pivotally interconnect two pivotal elements 10 and two links 24, the guide 12 so extending through a slot that the elements 10 are freely pivotable over a given angular range.

The wall tubes 2 which continue outside the vertical wall 6 are bent around the link connections so as to leave the link connections freely movable and accessible.

FIG. 3 shows the link connection in a least favourable position, i.e. on starting up of the steam generator, when the walls are still cold, so that the links 24 are at a slight angle to the wall 6. As the wall 7 increasingly heats up, the wall 7 expands and when normal operation is reached, the links 24 extend parallel to the wall 6. After starting, and until normal operation is reached, therefore, the girder 20 forms a load on the wall 6 so that there is a slight flexural stress on the wall 6. The bending moment is small, however, and its existence is relatively short. The girder 20 may also transmit a maximum loading to the wall 6 during the heating-up period only in exceptional cases, e.g. as a result of an explosion inside the steam generator.

The tension band 21 can be additionally reinforced, e.g. by reinforcing plates 27 (see FIG. 3) which can be fitted directly as extensions of the connecting elements 22.

Figure 6:
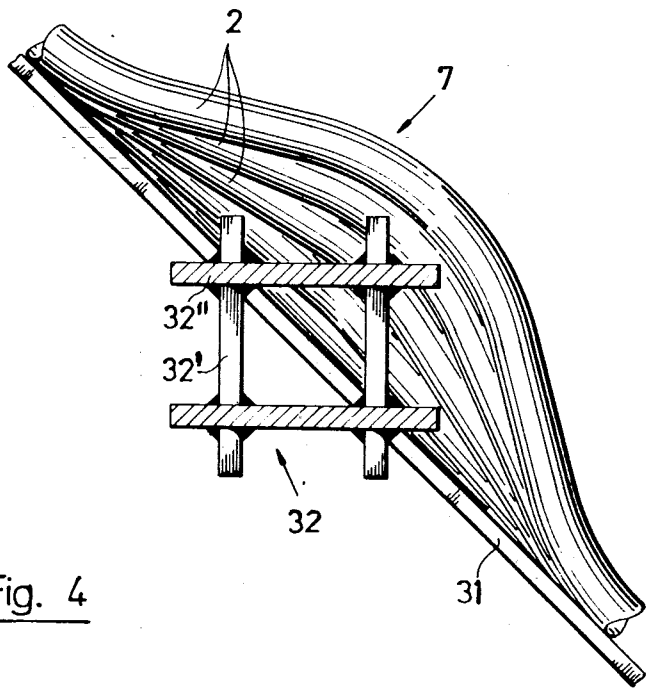
FIG. 6 illustrates a view taken on line VI—VI of FIG. 4.
Figure 4:
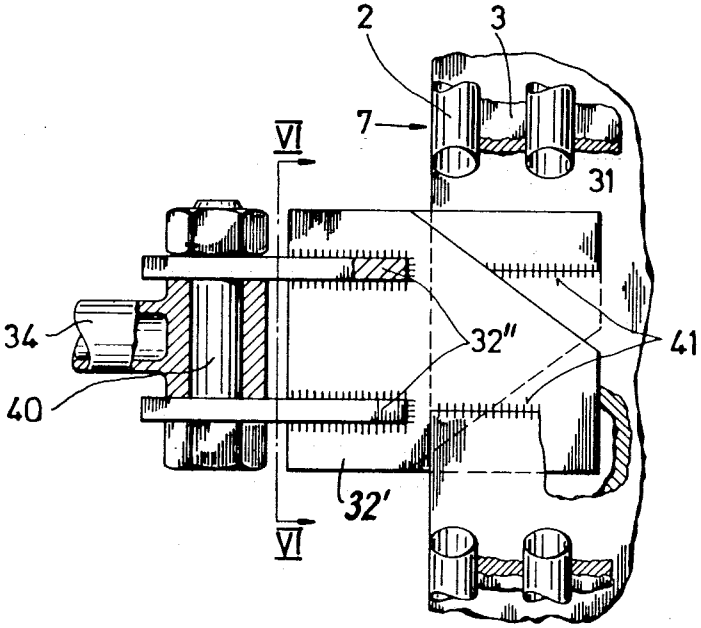
FIG. 4 illustrates a view of a modified connection in accordance with the invention.
Figure 5:
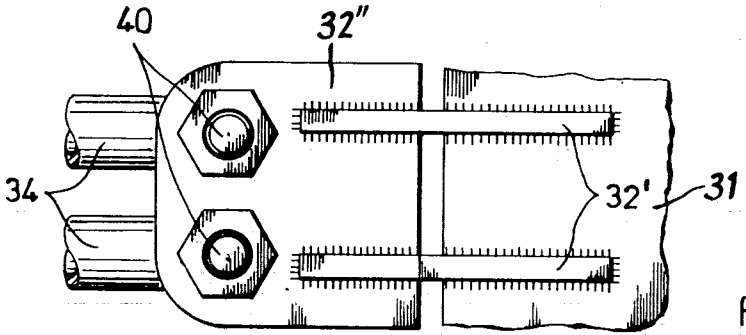
FIG. 5 illustrates a plan view of the connection of FIG. 4.

Referring to FIGS. 4 to 6, the connection of a girder 30 to one of the vertical walls 6 near the funnel 5, for example at the point B indicated in FIG. 1, has a tension band 31 rigidly welded to the inclined wall 7. In this case, the connection has a connecting element 32 formed of two flat vertical sheet-metal members 32' and two flat horizontal sheet-metal members 32''. The two vertical members 32' have the same shape but are arranged in mirror-image fashion side by side and fit into vertical slots through the tension band 31, to which each is welded symmetrically along fixing points 41. Both the horizontal sheet metal members 32'' have the identical and substantially retangular shape and are fitted in parallel superposed relationship into horizontal slots through the vertical members 32' to which they are welded in similar manner to the vertical members 32' and the tension band 31. Two substantially vertical bolts 40 extend through the horizontal member 32'', with a link 34 pivotally connected about each bolt 40. The other end of each link 34 is articulated to the girder 30 in a similar manner to that shown in the exemplified embodiment according to FIGS. 2 and 3.

As indicated in FIGS. 4 and 5, each pair of links 34 is pivotally connected symmetrically to the connecting elements 32 and on opposite sides of the central plane of the tension band 31 with each link 34 disposed on an axis parallel to the wall 7 and perpendicularly of the girder (not shown).

Referring to FIG. 6, the inclined wall has a portion bent around the connecting element 32 and spaced from the tension band 31. As indicated, the bent portion is directed inwardly of the steam generator so as to provide sufficient free space for mounting the vertical members 32'.

In operation, if the girder 30 is stressed by the wall 6, the girder 30 transmits a force via the links 34 and bolts 40 to the horizontal member 32'' of the connecting element 32. This force is then, in turn, transmitted to the vertical member 32' and thence to the wall 7 via the tension band 31. Since the links 34 and fixing points 41 are symmetrically arranged to the central plane of the tension band 31 extending parallel to the wall 7, the tension band 31 is subjected solely to tensile stress during normal operation. Since the central plane is disposed very close to the wall tubes 2, the resultant of the tension and the distance between the central plane of the tension strip and the tubes 2 can be disregarded. Also, the wall 7 experiences practically only tensile stress. This would, of course, be so even if only one link were provided per end portion of the girder 30 instead of the two links provided the longitudinal axis of the link 34 extends on the central plane of the tension strip 31.

Of note, the sheet metal members 32', 32'' need not be perpendicular to one another. Their relative angle and the angle between them and the tension band 31 can be freely selected. It is also possible to provide just one or more than two sheet metal members 32', 32'' which need not necessarily be parallel to one another and which may have different shapes, even other than flat. More than two sheet metal elements may also be disposed seriatim without affecting the symmetrical arrangement of the connection.

Figure 9:
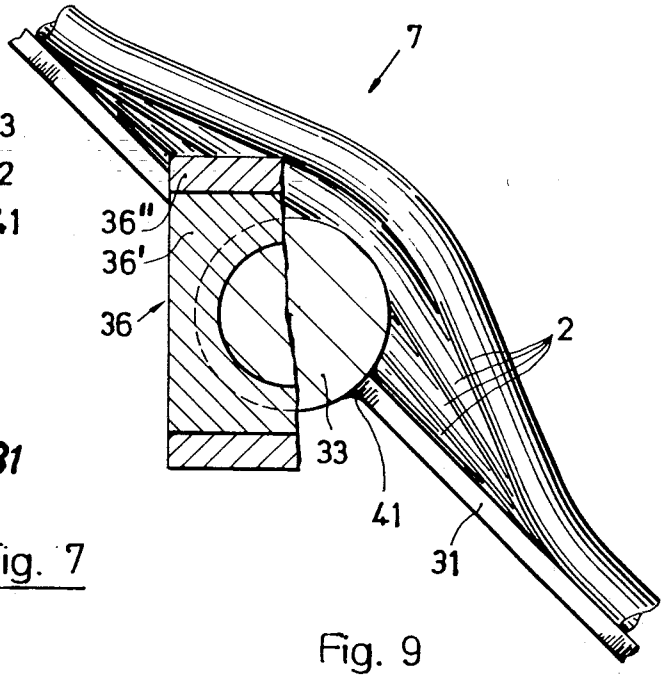
FIG. 9 illustrates a view taken on line IX—IX of FIG. 8.
Figure 7:
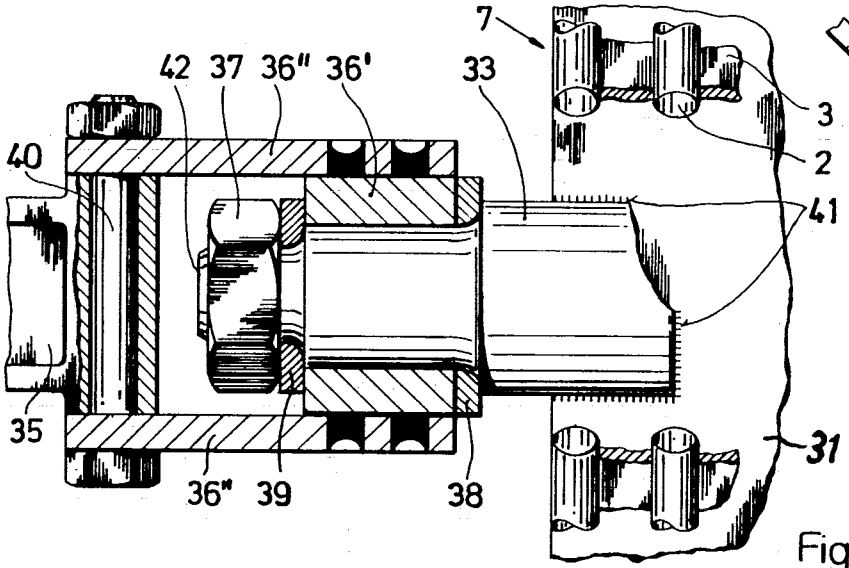
FIG. 7 illustrates a further modified connection in accordance with the invention.
Figure 8:
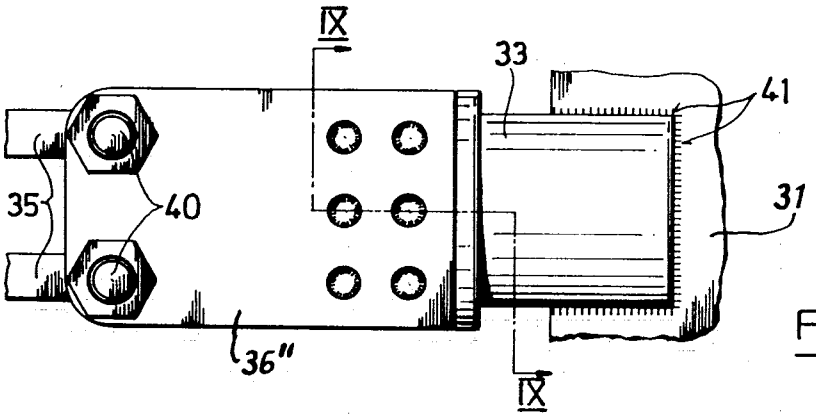
FIG. 8 illustrates a plan view of the connection of FIG. 8.

Referring to FIGS. 7 to 9, wherein like reference characters indicate like parts as above, the connection may be further modified for connecting a flanged girder 30 on a vertical wall to an inclined wall, for example at the point B of FIG. 1. In this case, a connecting element 33 consists of a substantially horizontal cylindrical member having three successively stepped diameters. A diametric slot is provided near the largest diameter at one end of the connecting element 33 and receives the tension strip 31 which is welded to the connecting element 33 along the slot edges. The smallest diameter is in the region of the other end of the connecting element 33, and is formed with a screwthread. An intermediate member 36 is rotatably disposed in the middle region of the connecting element 33 having the middle diameter and is axially fixed between two washers 38 and 39 by a nut 37 which is secured on the screwthread of the region having the smallest diameter. The nut 37 is locked by a weld 42. The intermediate member 36 comprises a cube 36' having a bore extending parallel to four of its sides, and of two flat sheet-metal members 36'' welded to the opposite side of the cube extending parallel to the bore. Each member 36'' has six bores, at which it is welded to the cube 36. Two vertical bolts 40 are also secured to the members 36' and two parallel H-section links 35 are pivotally disposed around the bolts 40. As in the previous examples, the links 35 are also pivotally connected to the girder 30 by bolts (not shown), the pivot axes of all the bolts extending parallel to one another.

The connecting element 33 is hollow and has substantially the same wall thickness as the tension band 31 in order to prevent thermal stresses due to the thick accumulation of material, while also improving the welding conditions.

In use, a force is transmitted from the girder 30 to the wall 7 in the same way as in the preceding examples, but the links 35 and hence the girder 30 can pivot without stress about the longitudinal axis of the connecting element 33. This additional degree of freedom is a significant contribution to preventing stresses and reducing assembly work. Further, the bend required for the wall 7 around the connecting element 33 (FIG. 9) is also much smaller than the case of the embodiment of FIGS. 4 to 6 around the connecting element 32.

Since the links 35 are not subject to any torsional stress, they can be of very simple design. Of course, here again, a single link 35 can be used instead of the two shown.

The exemplified embodiments according to FIGS. 4 to 6 and 7 to 9 respectively can also be used at places A′ and B′ in FIG. 1. The only difference is that the central plane of the tension band extends vertically at the points A′ and B′.

The features of the different exemplified embodiments may also be combined with one another to provide suitable structural solutions for specific problems.

As already stated, in designing a heat-exchanger, it must be remembered that thermal expansion may result in the relative position of the end part of a girder 30, 20 with respect to the associated tension band being different on starting up from normal operation. The design should obviously be such that the wall bearing the tension band is subjected solely to tensile stress during normal operation whereas, on starting up and under abnormally high operating temperatures, a certain flexural stress on the adjacent wall can be accepted.

Calculations show that these flexural stresses are very low, rapidly fall off when the temperatures move towards those of normal operation and can without difficulty be disregarded, particularly because of their short duration.

The invention thus provides a relatively simple connection for connecting the support girders of one wall of a heat exchanger to the adjacent walls so as to transfer flexural stresses therebetween.

What is claimed is:

1. A heat exchanger comprising a plurality of walls defining a vertical flue, each said wall including a plurality of interconnected tubes;

at least one first flanged girder extending parallel to one of said walls at a first level of said flue for receiving flexural stresses from said wall;

a first tension band rigidly connected in parallel to a second wall adjacent said one wall;

at least one first connecting element rigidly connected to said first tension band at predetermined fixing points disposed symmetrically of a central plane of said first tension band;

at least one first link mounted on said first connecting element and pivotally connected to one end of said first girder on an axis parallel to said second wall and perpendicular to said first girder, said first link being disposed to transfer a flexural stress from said first girder to said first tension band within said central plane of said first tension band;

at least one second flanged girder extending parallel to said second wall at a second level of said flue for receiving flexural stresses from said second wall;

a second tension band rigidly connected in parallel to said one wall;

at least one second connecting element rigidly connected to said second tension band at predetermined fixing points disposed symmetrically of a central plane of said second tension band; and at least one second link mounted on said second connecting element and pivotally connected to one end of said second girder on an axis parallel to said first wall and perpendicular to said second girder, said second link being disposed to transfer a flexural stress from said second girder to said second tension band within said central plane of said second tension band.

2. A heat exchanger as set forth in claim 1 wherein said second wall has a portion bent around said connecting element and spaced from said tension band.

3. A heat exchanger as set forth in claim 1 wherein said second wall includes a plurality of webs interconnecting said tubes thereof with said connecting element connected to at least some of said webs, whereby said second wall defines at least a part of said tension band.

4. A heat exchanger as set forth in claim 1 wherein said connecting element is a sheet metal member.

5. A heat exchanger as set forth in claim 1 wherein said connecting element is formed of at least one pair of sheet metal members disposed seriatim.

6. A heat exchanger as set forth in claim 1 which further comprises an intermediate member connected between said tension band end said link to pivot on an axis in said central plane and perpendicular to said link.

7. A heat exchanger as set forth in claim 1 which further comprises a pair of said links pivotally mounted on said connecting element on axes disposed perpendicular of said connecting element.

8. A heat exchanger as set forth in claim 7 which further comprises an element secured to said girder and pivotally connected to said link on an axis parallel to and symmetrical of said link.

9. A heat exchanger comprising a plurality of walls defining a flue, each said wall including a plurality of interconnected tubes;

a first flanged girder extending parallel to a first of said walls at a first level for receiving flexural stresses from said wall;

a first tension band rigidly connected in parallel to a second wall adjacent said one wal;

a second flanged girder extending parallel to said second wall at a second level spaced from said first level;

a second tension band rigidly connected in parallel to said second wall;

a pair of connecting elements connected to each respective tension band at predeterminded fixing points disposed symmetrically of a central plane of said respective tension band;

a first pair of links pivotally connected to a respective pair of connecting elements on an axis parallel to said second wall and perpendicularly of said first girder;

a second pair of links pivotally connected to a respective pair of connecting elements on an axis parallel to said first wall and perpendicular of said second girder; and a pair of guides connected to and projecting from one end of each respective girder, each said guide being connected to a respective pair of links on an axis parallel to a respective wall and perpendicular to said axis of a respective girder.

10. A heat exchange comprising a plurality of walls defining a flue, each said wall including a plurality of interconnected tubes;

a first flanged girder extending parallel to a first of said walls for receiving flexural stresses from said wall;

a first tension band rigidly connected in parallel to a second wall adjacent said one wall;

a second flanged girder extending parallel to said second wall at a second level spaced from said first level;

a second tension band rigidly connected in parallel to said second wall;

a connecting element rigidly connected to each respective tension band symmetrically of a central plane of said respective tension band; and a pair of links pivotally connected symmetrically to each respective connecting element and on opposite sides of said central plane thereof and articulated to one end of a respective girder, each link being disposed on an axis parallel to a respective wall and perpendicularly of a respective girder.

11. A heat exchanger comprising a plurality of walls defining a flue, each said wall including a plurality of interconnected tubes;

a first flanged girder extending parallel to a first of said walls for receiving flexural stresses from said wall;

a first tension band rigidly connected in parallel to a second wall adjacent said one wall;

a second flanged girder extending parallel to said second wall at a second level spaced from said first level;

a second tension band rigidly connected in parallel to said second wall;

a cylindrical connected element rigidly connected to each respective tension band symmetrically of a central plane thereof;

an intermediate element rotatably mounted on each said connecting element on an axis within said central plane thereof; and a pair of links pivotally connected symmetrically to each respective intermediate element and on opposite sides of said central plane thereof and articulated to one end of a respective girder, each link being disposed on an axis parallel to a respective wall and perpendicularly of a respective girder.

* * * * *